US005234156A

United States Patent [19]

Ribnitz

[11] Patent Number: 5,234,156

[45] Date of Patent: Aug. 10, 1993

[54] PROCESS AND APPARATUS FOR THE CONTINUOUS COATING OF WORKPIECES

[76] Inventor: Peter Ribnitz, Schubertstr. 7, 9008 St. Gallen, Switzerland

[21] Appl. No.: 543,825

[22] PCT Filed: Dec. 24, 1988

[86] PCT No.: PCT/EP88/01200

§ 371 Date: Jul. 9, 1990

§ 102(e) Date: Jul. 9, 1990

[87] PCT Pub. No.: WO89/06165

PCT Pub. Date: Jul. 13, 1989

[30] Foreign Application Priority Data

Jan. 9, 1988 [DE] Fed. Rep. of Germany ..... 3800448

[51] Int. Cl.[5] ..... B05D 7/22

[52] U.S. Cl. ..... 228/214; 219/10.55 M; 118/622; 118/317; 427/447

[58] Field of Search ..... 228/214; 427/28, 55, 427/33, 236, 239; 118/620, 622, 58, 308, 317, 666; 219/10.55 M

[56] References Cited

U.S. PATENT DOCUMENTS

| | | | |
|---|---|---|---|
| 2,643,955 | 6/1953 | Powers et al. | 118/308 X |
| 2,690,929 | 10/1954 | Johns | 118/317 X |
| 3,347,698 | 10/1967 | Ingham | 118/620 X |
| 3,526,027 | 9/1970 | Manuel et al. | 118/317 X |
| 3,995,075 | 11/1976 | Cernauskas et al. | 118/666 X |
| 4,327,665 | 5/1982 | Arrasmith | 118/666 |
| 4,421,790 | 12/1983 | Nagata et al. | 427/236 |
| 4,549,866 | 4/1986 | Granville | 432/10 |
| 4,588,605 | 5/1986 | Frei et al. | 427/181 X |
| 4,661,379 | 4/1987 | Frei et al. | 427/181 |
| 4,714,589 | 12/1987 | Auwerda et al. | 427/163 X |
| 4,759,946 | 7/1988 | Ribnitz | 427/8 |
| 5,064,494 | 11/1991 | Duck et al. | 219/10.55 M |

FOREIGN PATENT DOCUMENTS

| | | |
|---|---|---|
| 3127881 | 11/1982 | Fed. Rep. of Germany . |
| 3718625 | 12/1987 | Fed. Rep. of Germany . |

*Primary Examiner*—Kenneth J. Ramsey

*Attorney, Agent, or Firm*—Antonelli, Terry, Stout & Kraus

[57] ABSTRACT

A process and an apparatus serve for the continuous coating of workpieces, with a coating medium being applied to a zone to be coated on the workpiece that is passing the zone, and with heat being applied in this coating procedure, to produce a film from the coating medium at the zone. To reduce the size of the installation, a synthetic resin is sprayed toward the zone that is passing through, and heat is applied, at least predominantly, before the sprayed synthetic resin impinges on the zone, in order to reduce the size of the route up to where the film is formed.

32 Claims, 3 Drawing Sheets

PROCESS AND APPARATUS FOR THE CONTINUOUS COATING OF WORKPIECES

FIELD OF THE INVENTION

The invention relates to a process for the continuous coating of workpieces during which coating procedure a coating medium is applied to a zone to be coated of the passing-through workpiece, and heat is applied in order to produce from the coating medium a film at the zone. The invention furthermore relates to a coating installation for workpieces to be coated in continuous operation, with a coating device with a delivery means for a coating medium and with heating elements in order to produce a film on the workpiece with the coating medium, wherein the delivery means for the coating medium is maintained at a spacing with respect to the workpiece, and furthermore with a conveying means for conveying the workpiece relatively to the delivery means.

BACKGROUND OF THE INVENTION

Processes and facilities for the continuous coating of workpieces have been proposed in U.S. Pat. Nos. 4,549,866; 4,588,605, as well as 4,661,379. Other processes and facilities of the aforementioned type have been proposed in U.S. Pat. Nos. 3,526,027; 2,974,060; 3,077,171; 3,208,868; 3,394,450; 3,678,336; 3,840,138 and 4,098,226; European Laid-Open Applications 93,083; 132,229 and 160,886; as well as DOS 2,724,031.

It is furthermore known to coat workpieces, such as metal can bodies, with powder as the coating medium, for example, along their inner longitudinal weld seam. In this process, such can bodies are moved over a working arm from which powder is sprayed toward the zone to be coated. Customarily, the adhesion of the powder to the can body is electrostatically enhanced in this procedure by producing a high electrostatic field in the spray region and by charging the powder so that the force of the field urges the powder against the can body or the workpiece and retains the powder at those places. Subsequently to this powder coating step, the workpieces, and specifically the aforementioned can bodies, are moved through a long heating station having a length of several meters where the adhered powder is heated to such an extent that it forms a protective film in the coated zone. The length of the above-mentioned heating station depends on the transit velocities of such workpieces and has a length, as mentioned above, of several meters. This is a disadvantage from the viewpoints of the space required for such installations and the structural expenditure.

SUMMARY OF THE INVENTION

The invention is based on the object of drastically reducing the extension of such a treatment route, as well as the space requirement and the construction expenditure for installations operating in this way.

This object has been attained in accordance with the process set forth hereinabove by spraying a synthetic resin toward the transit zone, and applying the heat at least predominantly, prior to impingement of the sprayed synthetic resin, to the zone in order to reduce the extent of the length needed to produce the film.

In accordance with the apparatus set forth above, the object has been attained by fashioning the heating elements so that they heat the coating medium, at least predominantly, before it has passed from the delivery means through the free distance to the workpiece, in order to reduce the extent of the length needed to produce the film.

By spraying the synthetic resin and applying the heat prior to impingement of the sprayed synthetic resin onto the zone of the workpiece, the result is achieved that, downstream of the coating zone, no further heating sections need to be provided whereby in such continuous coating operations, a drastic reduction of the length of the treatment zone and, correspondingly, of the construction expense therefor, is achieved.

Synthetic resin spraying methods are known per se for the spraying of workpieces by means of spray guns in piecemeal individual production. Attention is invited in this connection to a reference by Metco, "Synthetic Resin Spraying" by Sen. Eng. H. Schwarz, revised by Dipl.-Ing. H.-E. Steinicke. The disclosure content of this reference is also incorporated into the disclosure of the present application by this reference thereto.

In the method described in this printed publication, a sprayed synthetic resin, in powder form or in the form of paste particles, is exposed to heat by gas flames along the path between a synthetic resin nozzle orifice and the workpiece to be coated. During the spraying of a coating resin, the powder particles are superficially melted along this route by the flame whereas, when spraying synthetic resins in paste form, the plastic particles are heated to such a degree that they are gelled along this route. One disadvantage of these synthetic resin spraying methods resides in that the heat is fed to the sprayed synthetic resin by flames which, on the one hand, especially in case of poorly accessible spraying regions, requires the feeding of a fuel gas with correspondingly long conduits and is problematic with respect to possible danger of fire and/or explosion. Especially in case of continuous coating procedures as discussed above for the inside areas of hollow bodies, such as can bodies, fuel gas lines must be extended through relatively long working arms, when using conventional synthetic resin spraying methods as mentioned above, until the coating zone is reached which is relatively expensive. Moreover, metering of the heat quantity supplied to the sprayed synthetic resin along its free flow path from the nozzle to the workpiece with the aid of gas flames is difficult.

In order to solve this problem, the present invention proposes, in a broader aspect, a synthetic resin spraying process wherein a synthetic resin is sprayed against the zone of a workpiece to be coated, and heat is applied to the workpiece predominantly before impingement of the sprayed synthetic resin on the workpiece in order to produce, at the zone, a film from the synthetic resin. The heat is produced at least predominantly by conversion of electrical energy into thermal energy. By virtue of the production of the required heat at least predominantly in an electrical fashion, metering of the supplied heat is possible with substantially higher precision than with the exclusive utilization of open gas flames and whereby, with heat supplied exclusively electrically, any danger of fire and/or explosion is precluded.

These last-mentioned problems are furthermore resolved by means of a coating device wherein a feed conduit arrangement for the coating resin is provided, with the feed conduit terminating at a delivery means, and with a heating unit being provided in order to heat the resin. The heating unit advantageously comprises at least one electrically operated heating arrangement.

As mentioned above, the required heat is fed, in the conventional synthetic resin spraying process, to the ejected synthetic resin spray exclusively along the route between the spray nozzle and the workpiece. Problems arise in this connection if the length of this route is predetermined and small for certain reasons, for example accessibility to a region to be sprayed. Considering, for example, small-diameter can bodies or hollow members to be coated on the inside, it can be seen that the distance between a spray arm extending into such hollow components and the inner wall of the latter is given by the diameter of the hollow components and accordingly such conditions restrict the usability of conventional synthetic resin spraying methods. The sprayed-out synthetic resin can nowise absorb the required heat along short free flow paths between the spray nozzle and the workpiece.

In order to overcome this drawback and to be able to utilize synthetic resin spraying methods even in case of short free flow paths of the sprayed synthetic resin, and accordingly to substantially facilitate the applicability of such methods, according to the present invention, the synthetic resin is supplied in a conduit arrangement to a spraying zone, with the heat being supplied to the synthetic resin, at least in part, as early as along at least one final section of the conduit arrangement.

According to this, the heat is supplied to the synthetic resin at least in part as early as along a final section of the synthetic resin conduit arrangement whereby the sprayed synthetic resin needs to absorb, if at all, merely a reduced amount of heat along the free flow section. This, in turn, makes it possible to reduce the length of this section.

A coating device, according to the present invention, includes a feed conduit arrangement for a coating resin terminating at a deliver means as well as a heating unit for heating the resin. The heating unit is arranged, at least in part, along a final section of the feed conduit arrangement and acts on the resin supplied therein.

A process for reducing the extent of the treatment distance in the continuous coating of workpieces without having to extend gas conduits to the spraying zone and, respectively, wherein a fine metering of the amount of heat supplied is possible, according to the present invention, by providing a process for the continuous coating of workpiece, during which coating, a coating medium is applied to a zone to be coated of the workpiece that is passing through, with heat being applied in order to produce a film from the coating medium at the zone. A synthetic resin is sprayed toward the zone that is passing through, and the heat is applied, at least predominantly, before the sprayed synthetic resin impinges on the zone, in order to reduce the size of the route up to where the film is formed.

In order to also provide for a reduction of the extent of the treatment distance in the continuous coating of workpieces and enable the coating of small diameter hollow components such as, for example, metal can bodies, in accordance with the process of the present invention, during the coating, a coating medium is applied to the zone to be coated of the workpiece that is passing through, and heat is applied in order to produce a film from the coating medium at the zone, with a synthetic resin being sprayed toward the zone that is passing through, and the heat is applied, at least predominantly, before the sprayed synthetic resin impinges on the zone in order to reduce the size of the route up to where the film is formed. The synthetic resin is supplied in a conduit arrangement to a spraying zone, with the heat being supplied to the synthetic resin, at least in part, as early as along at least one final section of the conduit arrangement.

Finally, a synthetic resin spraying process permitting a fine metering of the amount of heat supplied and likewise making its use possible even in case of small given free travel paths of the sprayed synthetic resin, i.e. also, for example, in case of small-diameter hollow bodies, is, according to the present invention, achieved by spraying the synthetic resin against a zone of a workpiece to be coated, with heat being applied to the workpiece predominantly before impingement of the sprayed synthetic resin on the workpiece in order to produce, at the zone, a film from the synthetic resin, with the heat being produced at least predominantly by conversion of electrical energy into thermal energy. The synthetic resin is advantageously supplied in a conduit arrangement to a spraying zone, with the heat being supplied to the synthetic resin, at least in part, as early as along at least one final section of the conduit arrangement.

A coating device wherein, on the one hand, fine metering of heat is readily feasible and which is suitable for use also in case of small free flow distances of the sprayed synthetic resin, thus, for example, for small-diameter hollow components, such as small-diameter can bodies, is, according to the present invention, achieved by providing a feed conduit arrangement for the coating resin, which feed conduit arrangement terminates at a delivery means, and with a heating unit heating the resin, with the heating unit comprising at least one electrically operated heating arrangement. The heating unit is arranged at least in part along the final section of the feed conduit arrangement and acts on the resin supplied therein.

Furthermore, in order to ensure a reliable, thoroughly covering film formation, in all aforementioned processes and in dependence on the sprayed synthetic resin, on the workpiece, it is also proposed to heat the workpiece to a predetermined temperature prior to impingement of the sprayed synthetic resin; when using a powder as the synthetic resin, the workpiece is to be heated to the melting temperature of the powder.

Frequently, a processing station is encountered upstream of a coating zone, in the continuous coating of workpieces, this processing station heating the workpiece being treated upstream of the coating zone. This is the case, in particular, in the processing of metal can bodies wherein metal can body blanks are first welded together along their longitudinal rims for the formation of closed can bodies in a welding station, a roller seam welding station, or a laser welding station and are thereafter coated, with a complete inner coating, an outer coating, or merely with an inside and/or outside coating in the region of their weld seam.

It is herein suggested to exploit this previously generated heat at the workpiece for heating the workpiece to the aforementioned, given temperature.

Thus, it is suggested, in particular, to utilize the welding heat in the manufacture of metal can bodies as the aforementioned, previously generated heat at the workpiece whereupon then the welded can bodies are preferably coated with a powdered synthetic resin and the heat is raised, starting with the produced welding heat, to the melting temperature of the sprayed synthetic resin powder.

The heat of the workpiece at the impingement region of the sprayed synthetic resin depends herein on the distance of the impingement region from the site of the preliminary heating, such as the aforementioned welding step.

In order to therefore make it possible to set the workpiece temperature at the point of impingement, it is suggested to adjust the distance of the aforementioned preheating step, such as the above-mentioned welding site, from the synthetic resin impingement zone at the workpiece in order to thus set the workpiece temperature at the impingement of the synthetic resin.

In order to take into account any varying operating conditions, such as changing travel velocities of the workpiece or changing preheating operations, it is furthermore proposed to measure the workpiece temperature after preheating and to automatically set the aforementioned distance in dependence on the measured temperature so that, at the impingement of the sprayed synthetic resin, the workpiece exhibits the predetermined temperature, thus, when spraying synthetic resin powder, the melting temperature of the powder.

As has been mentioned above, the metering of the heat fed in synthetic resin spraying processes to the sprayed synthetic resin by flames represents a problem in that excessive heat will bring about combustion of the sprayed plastic particles and heat which is too low will prevent the formation of a high-quality film on the workpiece.

In order to solve this problem in synthetic resin flame spraying, it is furthermore suggested to adjust the thermal coupling between the flames and the sprayed synthetic resin by an interposed curtain of a gaseous stream, preferably an air stream, of adjustable flow velocity.

In all of the above-discussed procedures of feeding the necessary heat to the sprayed synthetic resin, it is required to provide heating elements, either along the feeding conduit for the synthetic resin to the spraying zone or within the spraying zone. Thus, geometric coupling of provided heating elements with, in general, the feeding route of the synthetic resin is necessary. Conditions can arise in this connection, wherein, for example, for space reasons, a minimum of additional units, such as the aforementioned heating device at the end region of this conveying path for the synthetic resin, should be provided. Every heating device in the end zone of a synthetic resin conveying conduit with the appropriate connections, every gas burner unit in the orifice zone with the corresponding gas feed lines, requires space in the direct area of the coating zone.

In order to solve this problem, it is suggested to produce the heat predominantly by absorption of microwave energy in the sprayed synthetic resin. It becomes possible thereby to effect practically a "long-distance transmission" of the required amount of heat by being able to provide a microwave generator with the correspondingly radiating antenna arrangement at a distance from the spraying zone, and the plastic synthetic resin particles absorb the microwave radiation and are heated correspondingly.

This procedure is particularly suitable also in those cases where the workpiece is a hollow metallic article, with the area to be coated lying in the hollow space, especially a longitudinally welded metal can body wherein the area to be coated lies within the cavity and is especially the inner weld seam zone. In this article, a hollow space is formed between the hollow metal body and a tool arm carrying the spray delivery means where the microwave radiation is coupled in, this hollow space acting as a microwave conductor from the coupling-in zone to the spray jet of the synthetic resin.

All of the aforementioned processes and their corresponding combinations are excellently suitable for use for the inner covering of longitudinal weld seams of metal can bodies in the continuous operation procedure.

Advantageously, in accordance with the present invention, the coating device includes a heating unit comprising a microwave radiation source. Additionally, the heating unit may comprise an electrical heating arrangement located coaxially to the final section of the feed conduit arrangement.

In order to exploit, in a coating installation for workpieces to be coated in continuous operation, according to the present invention, a coating device is provided with a delivery means for a coating medium, with heating elements being provided for producing a film on the workpiece with the coating medium. The delivery means for the coating medium is maintained at a distance with respect to the workpiece, and a conveying device is provided for conveying the workpiece relative to the delivery means. The heating elements are fashioned so that they heat the coating medium, at least predominantly before the coating medium has passed from the delivery means through a free distance to the workpiece, in order to reduce the length of the route needed for producing the film.

Advantageously, the coating device includes a feed conduit arrangement for a coating resin which terminates at a delivery means, with a heating unit being provided for heating the resin, which heating unit comprises at least one electrically operated heating arrangement.

It is also possible in accordance with the present invention to provide for a coating device with a feed conduit arrangement for a coating resin terminating at a delivery means and a heating unit to heat the resin, with the heating unit being arranged at least, in part, along a final section of the feed conduit arrangement and acting on the resin supplied therein.

For coating of metal can bodies along a weld seam in a continuous operation, in accordance with the present invention, at least one delivery nozzle is provided for a coating resin on a working arm over which the can bodies are passed.

The coating insulation of the present invention preferably includes a fuel gas nozzle arrangement at least partially surrounding the nozzle for the coating resin. A compressed gas nozzle arrangement is provided between the fuel gas nozzle arrangement and the coating resin nozzle, with the compressed gas nozzle arrangement surrounding the coating resin nozzle at least over a large portion of its circumference. By virtue of this arrangement, a delivery zone is provided for the coating installation wherein the heat is supplied to the spray-out synthetic resin by gas flames.

In a manufacturing plant for metal can bodies, in accordance with the present invention, a welding unit is provided with a coating installation being arranged downstream thereof. A conveying means feeds unwelded can bodies to a welding unit so that, in the welding unit, the longitudinal weld seams are welded together, with the can bodies being moved by the conveying means through the coating installation. The coating device is arranged directly downstream of the welding unit, with the welding unit acting as a heating unit for the can bodies in order to bring the can bodies at the coating device to a predetermined temperature, preferably, the melting temperature of the synthetic resin powder delivered at the coating device.

Thus, the manufacturing plant, according to the present invention, includes a welding installation which enables a welding of the longitudinal weld seams of the can bodies as well as, downstream of the welding installation, a coating installation according to the present invention, as well as a conveying device for transporting the can bodies in a continuous operation through the welding installation and the coating installation. With the coating device of the coating installation arranged immediately downstream of the welding installation, the welding installation acts as a heating unit for the can bodies in order to raise the temperature of the can bodies at the coating device to the predetermined temperature and, in particular, in synthetic resin powder coating, to the melting temperature of the resin powder.

In accordance with still further features of the present invention, in the manufacturing plant, the distance between the delivery means at the coating device and the welding point at the welding unit is adjustable.

Furthermore, in the manufacturing plant of the present invention, a temperature measuring device is provided downstream of the welding unit for measuring the temperature in a zone of the welded metal can bodies, with the temperature measuring device acting on an output side of a setting unit for the distance.

Furthermore, in order to enable adjustment of the distance, in accordance with the present invention, pivot means are provided for pivotally supporting the delivery means.

In accordance with still further features of the present invention, in a coating installation for hollow medical articles such as workpieces to be internally coated in a continuous operation, the coating device with the delivery means is carried by an at least partially metal-coated working arm projecting into the metal articles. A microwave transmitter acts between the metal article and the arm with the arm acting as microwave conductors between the transmitter and the delivered coating medium.

BRIEF DESCRIPTION OF THE DRAWINGS

The invention will be described below by way of example with reference to the drawings wherein.

DETAILED DESCRIPTION

Figure 1:
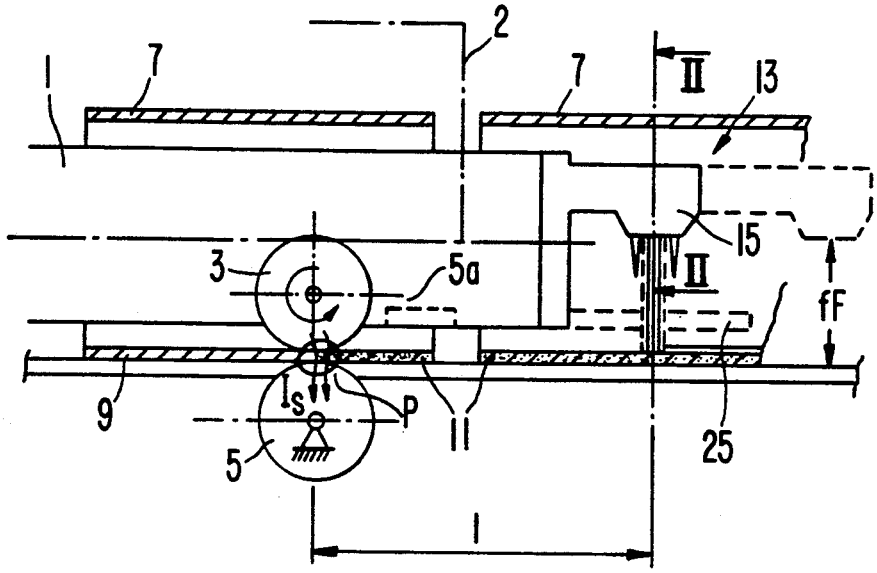
FIG. 1 is a schematic view of a manufacturing plant according to this invention for metallic can bodies, with a welding facility and a coating facility according to this invention.

FIG. 1 illustrates a synthetic resin coating installation according to the invention, in this case for synthetic resin powder to coat the inside of hollow articles, this installation operating in accordance with the process of this invention. Specific reference is had herein to the inner coating of longitudinal weld seams on metal can bodies.

Metal can bodies 7 are lap welded or butt welded along their previously open longitudinal edges 9 at a welding arm 1 of a welding facility 2 of known structure comprising a welding roller 3 and a counter roller 5, thus producing a weld seam 11. Since such welding installations are known in a great variety of versions, also in the form of laser welding facilities and, considered by themselves, are not the subject of the present invention, FIG. 1 illustrates, by way of example ample, one kind of such a welding installation for the aforementioned use. In the roller seam welding facility shown here, resistance welding is effected by conducting a high welding current $I_S$ from one roller to the other by way of the longitudinal edges 9 to be welded together. The welding point P is located here, defined correspondingly in accordance with the welding facility employed.

Figure 2:
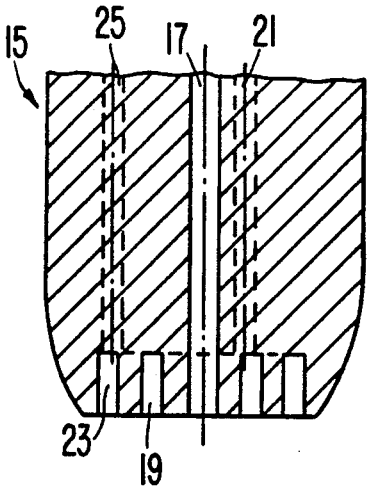
FIG. 2 shows a schematic longitudinal sectional view, on an enlarged scale, of a synthetic resin delivery nozzle arrangement in the coating device of this invention pertaining to the coating installation according to FIG. 1.

Directly following the welding facility 2, for example, at a spacing of about 100 mm from the welding point P, a synthetic resin powder coating arrangement 13 is attached, according to this invention, to the welding arm 1 at a terminal location. This coating arrangement comprises one or, as illustrated in dashed lines, several series-arranged nozzle units 15 one of which is shown in an enlarged sectional view along line II—II in FIG. 2.

A synthetic resin, feed conduit 17 terminates centrally at the nozzle arrangement 15 and delivers, pneumatically supported through the welding arm 1, a coating powder plastic, preferably a synthetic resin powder. In place of powdered plastic, it is optionally also possible to deliver a pasty synthetic resin through conduit 17 in a finely atomized fashion.

As for the technology for synthetic resin spraying, understood to mean synthetic resin powder spraying as well as the spraying of paste-like synthetic resins, attention is invited to the article "Synthetic Resin Spraying" by Senior Engineer H. Schwarz at page 380 et seq.

At least along a portion of its circumference, the synthetic resin powder feed conduit 17 or, more generally, the synthetic resin feed conduit 17, is surrounded by a compressed air nozzle arrangement 19 supplied with compressed air via a compressed air line 21 extended through the welding arm 1. The compressed air nozzle arrangement 19 may include a slotted nozzle or a plurality of discrete nozzle orifices distributed around at least a major portion of the outlet opening of the synthetic resin feed conduit. In a radially outwardly progressing manner, the compressed air nozzle arrangement 19 is surrounded, at least along a large portion of the periphery of the synthetic resin feed conduit 17, by a gas burner nozzle arrangement 23 which nozzle arrangement, in turn, is supplied with gaseous fuel by a gas feed conduit 25 extended through the welding arm 1.

Figure 3:
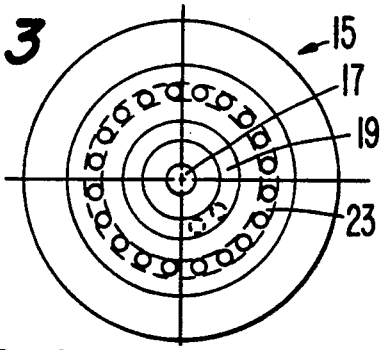
FIG. 3 shows schematically a plan view of the arrangement according to FIG. 2.

FIG. 3 shows on an enlarged scale, a plan view of the outlets at the nozzle arrangement 15. In this embodiment, the compressed air nozzle arrangement 19 is shown to be an annular slotted nozzle, and the gas burner nozzle arrangement 23 is shown to include discrete nozzle orifices. In this arrangement, both slotted nozzles or both nozzle arrangements 19, 23 can also be formed from discrete nozzle orifices. The synthetic resin delivered from the plastic feed conduit 17 is sprayed according to FIG. 1 through a free travel distance fF toward the weld seam 11 of the can bodies 7 and, while passing through this route fF, is heated by the gas flames burning on the outlet side of the gas burner nozzle arrangement 23, to such an extent that synthetic resin powder particles are superficially molten, and paste-like plastic particles are heated to such a degree that they gel. The heat transfer between the gas flames and the ejected synthetic resin is set by adjusting the compressed air jet from the compressed air nozzle arrangement 19. While in the synthetic resin powder spraying operation, here preferred and explained in more specific detail below, it is the substrate, i.e. here the weld seam region 11, which must be preheated to the melting temperature of the synthetic resin powder, such procedure is unnecessary when using synthetic resin pastes. In view of the fact that, according to FIG. 1, the total length of the installation resulting from the coating facility is to be kept at a minimum and, due to the welding step, the workpiece to be coated, here the can bodies 7, have already been heated up to a high degree, it can be seen that, with the use described herein, preference is given to synthetic resin powder coating. The condition, namely, that the substrate must be raised to the melting temperature, has already been met by the welding operation at a small distance from the welding point P. In contrast, with the use of paste-like synthetic resin particles, cooling of the workpiece should first be permitted after the welding step, requiring additional facilities and/or an extension of the distance 1 between the welding point P and the coating. The most advantageous combination thus evolves of the described coating process with synthetic resin powder and a welding installation for workpieces in continuous operation, especially for the inside and optionally outside coating of longitudinal weld seams of metal can bodies in that, in the present arrangement, the workpiece is heated anyway to the temperature values necessary for the coating procedure.

Figure 4:
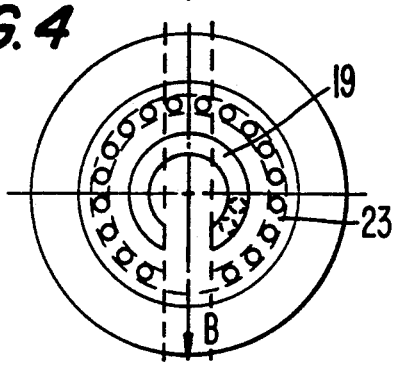
FIG. 4 shows a view according to FIG. 3 of a further embodiment of the nozzle arrangement in accordance with FIG. 2, for a weld seam coating in a manufacturing plant according to FIG. 1.

As illustrated in FIG. 4 analogously to the illustration of FIG. 3, it is possible to interrupt, for the aforementioned weld seam coating within a relatively limited zone corresponding to the strip B indicated in FIG. 4, the compressed air nozzle arrangement 19 as well as the fuel gas nozzle arrangement 23 in the outlet direction of the coated seam, in order to prevent the already coated zone from coming into direct contact with the open flame at the burner nozzle arrangement 23 when exiting from the nozzle zone.

As shown in dashed lines in FIG. 1, a bilateral restriction mask 25, as seen in the direction of movement of the nozzle members 7, can furthermore be provided for delimiting the synthetic resin strip applied to the seam 11. This mask determines a clearly defined pass-through slot for the ejected synthetic resin.

As mentioned above, in the synthetic resin powder coating operation, here preferred, the temperature of the workpiece at which the coating step is performed on the workpiece is of essential importance for the formation of a high-quality film.

Figure 5:
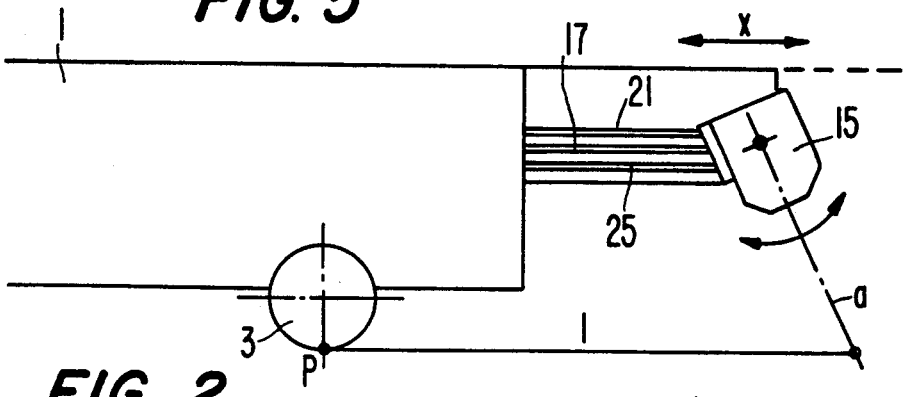
FIG. 5 shows schematically an installation according to FIG. 1 wherein the distance between the heat-generating welding installation and the application zone of the coating is adjustable.

As can be seen from FIG. 5, the distance 1 between the welding point P and the impingement zone of the synthetic resin jet, for example the point of impingement of its stream axis a, can be varied, and with this the cooling distance corresponding to 1. Although this setting can be effected by linear displacement of the nozzle arrangement 15 in the direction X with a correspondingly flexible design of the compressed air conduit 21, the synthetic resin conduit 17 and the fuel gas line 25, a simpler structural version is achieved, as illustrated in FIG. 5, by making the nozzle arrangement 15 pivotable.

The distance 1 is, in the powdered synthetic resin coating procedure, an important variable, especially in correspondence with the temperature of the weld seam, $\nu_P$ at the welding point.

Figure 6:
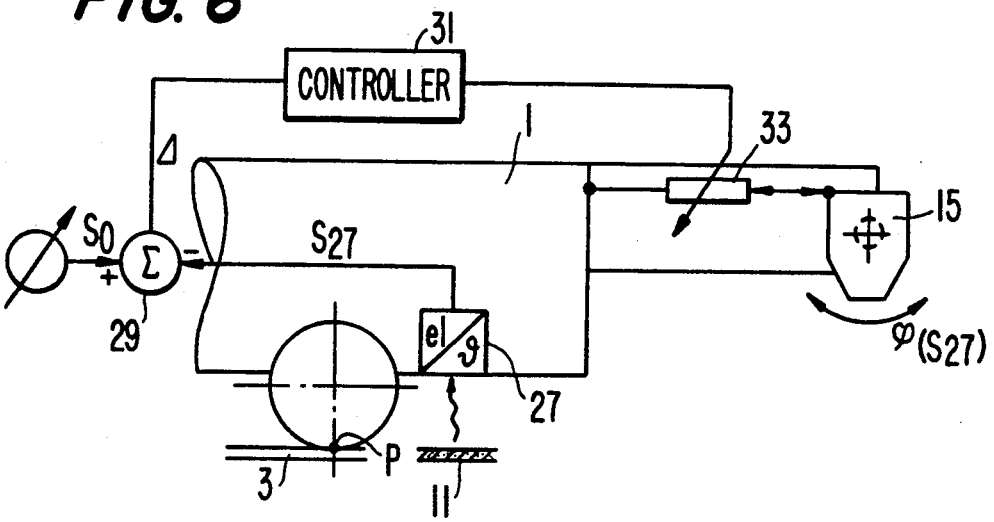
FIG. 6 shows schematically a further development of the arrangement according to FIG. 5 for the automatic follow-up adjustment of the aforementioned distance.

According to FIG. 6, in a further development of the embodiment according to FIG. 5, a heat detector 27 is now arranged downstream of the welding point P, e.g. at the welding arm 1, and in the proximity of the weld seam 11, for example a pyrotechnical detector which detects the temperature of the weld seam region. Its electrical signal $s_{27}$ on the output side is compared in differential unit 29 with an adjustable signal value $s_0$ corresponding to a desired temperature. A resultant deviation $\Delta$ is amplified in a controller stage 31 with a corresponding frequency response and sets, via a motor drive mechanism 33, the angular position $\phi$ and thus the lenght $1(\phi)$ dependent thereon between the welding point P and the axis a of the plastic jet. If the measured temperature according to $s_{27}$ is too small, then the nozzle arrangement 15 is pivoted toward the left in FIG. 6, and in the reverse direction if the measured temperature is too high.

Of course, instead of utilizing a welding station as illustrated in FIGS. 1, 5 and 6 as a preheating source, it is possible to provide a heat source especially for this purpose, such as a burner, an infrared radiator. In such a case, exactly the same remarks as above apply with respect to the variable 1, but with reference to this separately provided source, illustrated in FIG. 1 at 5*a* in dashed lines.

On account of the illustrated structure of the nozzle 15 where, by means of the compressed air stream, the heat flow from the gas flame to the plastic stream can be finely metered, which can optionally also be omitted if the burner flame per se can be correspondingly finely adjusted, it is possible in spite of relatively short distances between the exit of the synthetic resin and the workpiece, according to free travel distance fF in FIG. 1, to coat weld seams of metal can bodies by means of powdered or paste-like synthetic resins without the necessity for providing, as in conventional methods, a heating zone with linearly arranged burners downstream of a powder applicator with electrostatic powder adhesion enhancement, which heating zone has a length of several meters. The expense for the total installation and for the coating facility in particular is thereby drastically reduced.

Although satisfactory and promising results have already been achieved by the technique disclosed thus far, especially in internal synthetic resin powder coatings of metal can weld seams, right from the beginning, the problem of the small length of the free travel distance fF according to FIG. 1 is clearly apparent, particularly with small-diameter cans.

Figure 7:
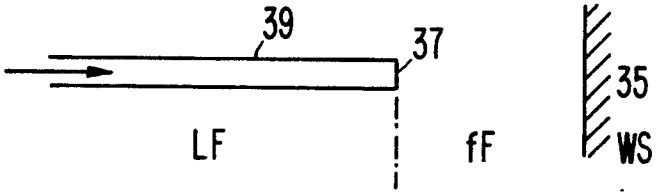
FIG. 7 is a schematic view of a synthetic resin feed conduit and a workpiece to be coated, with the sections passed through by the supplied synthetic resin.

According to FIG. 7, the traversed route of the synthetic resin coating composition up to impingement on a workpiece 35, such as the can body 7 in FIG. 1, can basically be divided into two segments, a first conduit conveying segment LF up to the outlet orifice 37, and a second segment, the free travel distance fF.

Figure 8:
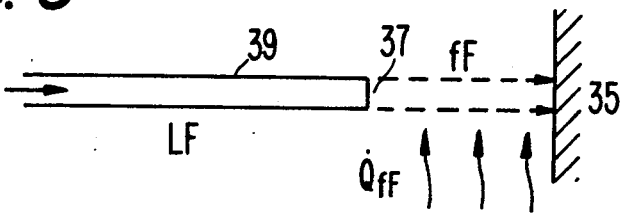
FIG. 8 shows, in an illustration according to FIG. 7, the supply of heat in conventional synthetic resin spraying processes.

In the conventional synthetic resin spraying methods, the conduit conveying segment LF, as shown in FIG. 8, is not utilized, in the sense that heat $\dot{Q}_{fF}$ is transmitted to the plastic stream, supplied by being conveyed in a plastic feed conduit 39 up to its outlet 37, be this a stream of powder or paste, only in the free travel distance. This is necessary for forming a synthetic resin film on the workpiece 35 in correspondence with the synthetic resin utilized. Precisely in view of the technique for the inside coating of can bodies illustrated in FIG. 1, it is apparent that in some cases of application the free travel distance fF should be maintained to be as short as possible, but this will reduce the heat absorbable along this distance by the sprayed synthetic resin.

Figure 9:
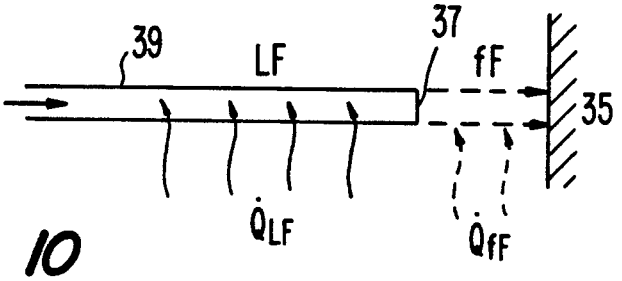
FIG. 9 shows, in an illustration according to FIG. 7, the supply of heat to the synthetic resin in accordance with this invention.

As shown schematically in FIG. 9, the present invention additionally has the objective of feeding heat $\dot{Q}_{LF}$ to the synthetic resin transported in conduit 39 as early as in the conduit conveying section LF, optionally additionally to a heat $\dot{Q}_{fF}$ fed in the free travel distance fF. This makes it possible to reduce the length of the free travel distance fF. This procedure is, of course, excellently suitable for combination with the technique illustrated in FIGS. 1 through 6, but does produce quite generally the advantages mentioned above in those cases where the required length of the free travel distance fF represents a problem for the application of synthetic resin spraying methods.

Figure 10:
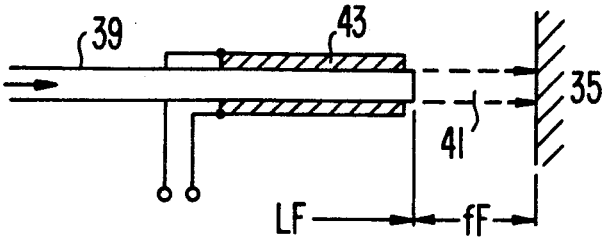
FIG. 10 shows, in an illustration according to FIG. 7, the provision of heating elements along the synthetic resin feed conduit for realizing the process according to FIG. 9.

As illustrated schematically in FIG. 10, heat is supplied to the synthetic resin stream, changing over into the plastic jet 41 downstream of the orifice 37, already along the conduit 39 by means of an electrical heating element 43, such as resistance heating cartridge, encompassing the conduit 39 coaxially to the latter. Depending on the plastic employed, this amount of heat delivered by the heating element 43 and absorbed by the plastic can already be sufficient for superficially melting the powder particles, as necessary, in case of a powder, or, in case of synthetic resin pastes, for gelling the plastic particles. If these required conditions are not as yet attained along the conduit conveying segment LF, or if they are preferably prevented from being met, for example, in order to avoid caking of the synthetic resin on the pipe wall, the remainder of the necessary quantity of heat is introduced additionally in the free travel distance fF. This can be done, for example, by gas flames as has been explained in the specific usage with reference to FIGS. 1–6, but is preferably realized without additional supply of fuel gas. For this purpose, a compressed air conveying conduit 45 is provided coaxially to the synthetic resin conveying conduit 39. This fuel gas line terminates coaxially to the orifice 37, as has been explained with reference to FIGS. 2, 3 and 4. The heating element 43 coaxially surrounds the compressed air conduit 45 and heats, in the conduit conveying section LF, the synthetic resin supplied in conduit 39 as well as the compressed air in the compressed air conduit 45. Due to the fact that the heated compressed air continues to feed heat to the synthetic resin stream 41 after exiting into the free travel distance fF, the objective is attained that the plastic particles reach the required temperature only directly prior to impingement on the workpiece 35. As mentioned above, the procedure according to this invention can supply heat to the conveyed synthetic resin as early as in the conduit conveying section LF, by electrical and, optionally, exclusively electrical means, can be utilized in general with synthetic resin spraying processes, and, in particular, also for the internal coating of can bodies, such as for the inside coating of the weld seam zone in metallic can bodies where the short length of the free travel distance fF can represent a problem especially with small-diameter cans for the use of conventional synthetic resin spraying processes according to FIG. 8.

Figure 11:
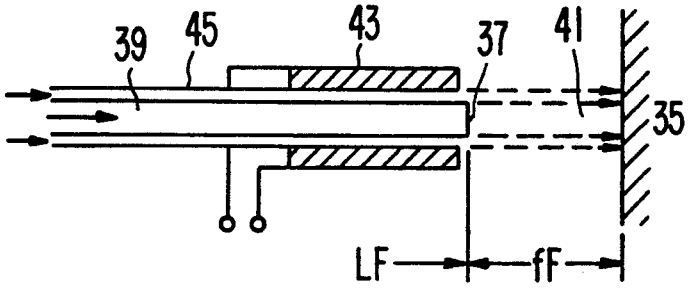
FIG. 11 shows, in an illustration according to FIG. 10, a further embodiment for supplying heat electrically to the supplied synthetic resin in the feed conduit as well as thereafter.
Figure 12:
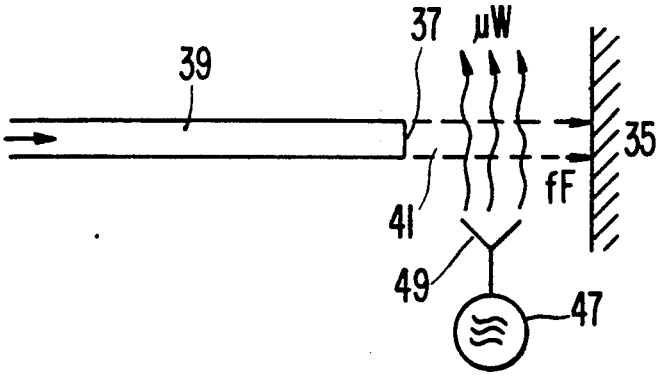
FIG. 12 shows, in an illustration according to FIG. 7, the supply of heat to the sprayed synthetic resin by means of microwaves.
Figure 13:
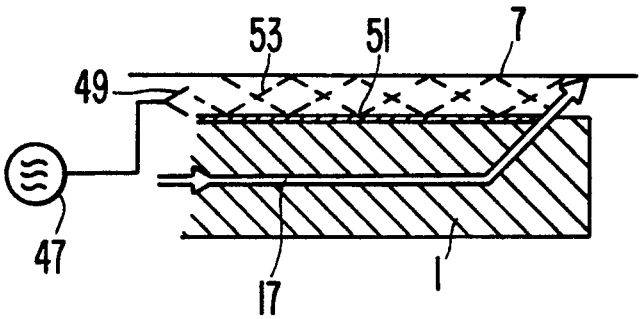
FIG. 13 shows, in an installation according to FIG. 1 for the inside coating of metal can bodies, the utilization of microwave energy for supplying heat to the sprayed synthetic resin.

Starting with the exclusively electrical heating of the synthetic resin for synthetic resin spraying methods, the procedure schematically shown in FIG. 12 is likewise suitable wherein uniform heating is provided for a synthetic resin fed through the supply conduit 39, optionally having been preheated therein. The synthetic resin jet 41 issuing from the orifice 37 is constituted, as is known, by synthetic resin particles. Based on their relatively high permittivity, these particles absorb the energy $\mu$W of microwave radiation. Based on this fact, the synthetic resin stream 41 is exposed to microwave radiation $\mu$W in the free travel section fF according to FIG. 12, optionally after preheating according to FIG. 10 or 11. For this purpose, a microwave generator 47 is provided, the output signal of which transmits radiation via an antenna arrangement 49 into the free travel distance fF. This procedure is especially suitable for the coating of metallic workpieces, consequently also for the specific usage explained in connection with FIG. 1. This usage is illustrated schematically in FIG. 13. The microwave generator 47 with antenna arrangement 49 radiating into the interspace between the welding arm 1 and the metallic can body 7 is provided at the welding arm 1 with the synthetic resin feed conduit 17 from which the plastic stream is sprayed against the metallic can body 7. The surface of the welding arm 1 is equipped with a metal layer 51 so that a cavity 53 defined by metallic surfaces is created between the metal can body 7 and the surface of the welding arm 1. This cavity 53 acts, depending on its dimensioning, as a microwave conductor or resonator and yields a wave propagation as indicated schematically by dashed lines from the antenna 49 toward the plastic jet exiting from conduit 17. On account of this structure, it is thus possible to conduct the microwave energy at low losses up to the sprayed-out plastic jet where this energy is absorbed by the synthetic resin particles, with a corresponding energy and thus heat absorption which is extensively uniform over the stream cross section.

The following advantages are attained by the present invention:

By using the synthetic resin spraying process as described herein, and/or of the corresponding coating arrangement, for the internal coating of hollow articles in continuous operation, here in particular the internal coating of the weld seam zone of can bodies, the feature that the manufacturing lines for such bodies can be substantially shortened in that there is no need for the provision of burner and/or heating arrangements downstream of the coating installations, for melting the coating material on the body.

Due to utilization of the conduit conveying section for the heating of supplied synthetic resin, the feature that synthetic resin spraying methods can also be utilized for short free travel segments, i.e. for short distances between the synthetic resin nozzle orifice and the workpiece.

On account of the use of electrical thermal energy, the feature that, in synthetic resin spraying processes, the feeding of fuel gas and the corresponding nozzle arrangements with possible danger of fire and/or explosion, are eliminated.

Advantages of possible inventive combinations of the basic procedure of this invention, based thereon, with respect to the process and/or the apparatus, can be clearly derived from the preceding description.

I claim:

1. Process for coating workpieces continuously conveyed through a coating station, the process comprising the steps of:

spraying including atomizing the synthetic resin in particles as a free jet of synthetic resin particles toward said workpieces so that said synthetic resin impinges upon said workpieces, heat treating said synthetic resin so as to form a coating of synthetic resin on said workpieces, and cooling said workpieces with said synthetic resin coating, wherein said heat treating of said synthetic resin is carried out at least after spraying and predominantly prior to impinging of said synthetic resin on said workpieces so as to superficially melt or gel particles of said synthetic resin.

2. A process according to claim 1, wherein the step of heat treating includes preheating the workpieces before impingement of the sprayed synthetic resin on the workpieces.

3. A process, for coating workpieces continuously conveyed through a coating station, the process comprising the steps of:

spraying the synthetic resin in particle form toward said workpieces so that said synthetic resin impinges upon said workpieces, heat treating said synthetic resin so as to form a coating of synthetic resin on said workpieces, and cooling said workpieces with said synthetic resin coating, wherein said heat treating of said synthetic resin is carried out at least after spraying and predominantly prior to impinging of said synthetic resin on said workpieces, the step of spraying includes supplying synthetic resin through a conduit arrangement to a spraying zone, and wherein the step of heating includes preheating the synthetic resin within the conduit arrangement.

4. A process according to claim 1, wherein the sprayed synthetic resin is a synthetic resin powder.

5. A process according to claim 1, wherein the step of heat treating includes preheating the workpieces in a previous manufacturing step of the workpieces, whereby previously generated heat in the workpieces is utilized for heating the workpieces to a predetermined melting temperature of the synthetic resin.

6. A process according to claim 5, wherein said manufacturing step is a welding step.

7. A process according to claim 1, wherein the step of heat treating includes preheating said workpiece prior to impingement of the sprayed synthetic resin, and wherein the process further comprises adjusting a distance between a means for preheating the workpieces and an impinging surface of the workpieces so as to adjust the temperature of the workpieces upon impingement of the synthetic resin on the surface of said workpieces.

8. A process according to claim 7, further comprising the steps of measuring the temperature of the workpieces after the preheating, and automatically adjusting the distance to maintain the temperature at the melting temperature of the synthetic resin.

9. A process according to claim 1, wherein the step of heat treating includes heating the synthetic resin by a flame of a fuel gas.

10. A process according to claim 9, further comprising the step of adjusting a thermal coupling between said flame and said sprayed synthetic resin by interposing a curtain stream of a gas.

11. A process according to claim 1, wherein the step of spraying includes atomizing the synthetic resin.

12. A process according to claim 1, wherein the workpieces are metal can bodies welded along a longitudinally extending seam, and wherein the step of spraying includes directing the spray of synthetic resin in a direction of the longitudinally extending seams of the metal can bodies.

13. Coating installation for workpieces, the coating installation comprising:

conveying means for continuously conveying the workpieces along a predetermined path;

spray means for atomizing a synthetic resin in a free jet of synthetic resin particles on said workpieces, said spray means being disposed adjacent said conveyor means and including a nozzle means directed toward said predetermined path for said workpieces;

heating means for heating the synthetic resin, at least predominantly, between said nozzle means and said predetermined path so as to heat the synthetic resin sprayed from said nozzle means to superficially melt or gel the synthetic resin particles before said sprayed resin reaches said predetermined path.

14. Coating installation according to claim 13, further comprising a fuel gas nozzle means adjacent the nozzle means for the synthetic resin, and wherein said heating means includes a gas burner cooperable with said gas nozzle means.

15. A coating installation according to claim 14, further comprising a compressed gas nozzle means arranged between said fuel gas nozzle means and said nozzle means so as to enable an adjustment of heating of said synthetic resin sprayed from said nozzle means by adjusting a stream of compressed gas through said compressed gas nozzle means.

16. Coating installation according to claim 13, comprising a welding means for said workpieces disposed directly upstream of the spray means, said welding means forming a part of said heating means and being adapted to preheat the workpieces to a predetermined preheat temperature.

17. Coating installation according claim 16 further comprising temperature measuring means for measuring a temperature of the workpieces and controlling the preheating of the workpieces.

18. A coating installation according to claim 13, further comprising a preheating unit arranged upstream of said nozzle means for preheating said workpieces.

19. A coating installation according to claim 18, wherein said preheating means includes a treating unit for said workpieces.

20. A coating installation according to claim 19, wherein said workpieces are metal can bodies, and wherein said treating unit is a welding means for welding a longitudinally extending seam internally of said metal can bodies.

21. A coating installation according to claim 13, wherein said workpieces are can bodies, and wherein said spray means is provided on an arm projecting into said can bodies conveyed by said conveying means.

22. A coating installation according to claim 13, further comprising preheating means disposed upstream of said nozzle means for preheating said workpieces, and adjusting means for adjusting a distance between said preheating means and said nozzle means.

23. A coating installation according to claim 22, further comprising temperature measuring means automatically adjusting said distance so as to maintain a temperature of said workpieces at a predetermined position along said path at a predetermined value.

24. A coating installation according to claim 13, further comprising preheating means disposed upstream of said spray means for preheating said workpieces so as to reach a predetermined temperature as said synthetic resin reaches said path, and adjusting means for adjusting a distance between said preheating means and a location where the sprayed synthetic resin reaches said path.

25. A coating installation according to claim 24, further comprising temperature measuring means for automatically controlling said adjusting means to maintain a temperature of said workpieces at said location at a predetermined value.

26. A coating installation according to claim for workpieces, the coating installation comprising:

conveying means for conveying the workpieces along a predetermined path;

spray means for spraying a synthetic resin on said workpieces, said spray means being disposed adjacent said conveyor means and including a nozzle means directed toward said predetermined path for said workpieces;

heating means for heating the synthetic resin, at least predominantly, between said nozzle means and said predetermined path so as to heat the synthetic resin sprayed from said nozzle means predominantly before said sprayed resin reaches said path;

preheating means disposed upstream of said nozzle means for preheating said workpieces; and adjusting means for adjusting a distance between said preheating means and said nozzle means, and wherein said adjusting means includes a pivot means for said nozzle means.

27. A coating installation, for workpieces, the coating installation comprising:

conveying means for conveying the workpieces along a predetermined path;

spray means for spraying a synthetic resin on said workpieces, said spray means being disposed adjacent said conveyor means and including a nozzle means directed toward said predetermined path for said workpieces;

heating means for heating the synthetic resin, at least predominantly, between said nozzle means and said predetermined path so as to heat the synthetic resin sprayed from said nozzle means predominantly before said sprayed resin reaches said path;

preheating means disposed upstream of said spray means for preheating said workpieces so as to reach a predetermined temperature as said synthetic resin reaches said path; and adjusting means for adjusting a distance between said preheating means and a location where the sprayed synthetic resin reaches said path, and wherein said adjusting means comprises means for pivoting said nozzle means.

28. A process, for coating workpieces continuously conveyed through a coating station, the process comprising the steps of:

spraying the synthetic resin in particle form toward said workpieces so that said synthetic resin impinges upon said workpieces, heat treating said synthetic resin so as to form a coating of synthetic resin on said workpieces, and cooling said workpieces with said synthetic resin coating wherein the step of heat treating includes subjecting the sprayed synthetic resin to microwave radiation.

29. A process according to claim 28, wherein the workpieces are hollow metallic articles, further comprising the step of coupling the microwave radiation within a cavity of the hollow metallic article.

30. Coating installation for workpieces, the coating installation comprising:

conveying means for conveying the workpieces along a predetermined path;

spray means for spraying a synthetic resin on said workpieces, said spray means being disposed adjacent said conveyor means and including a nozzle means directed toward said predetermined path for said workpieces;

heating means for heating the synthetic resin, at least predominantly, between said nozzle means and said predetermined path so as to heat the synthetic resin sprayed from said nozzle means before said sprayed resin reaches said path, wherein said spray means includes feed conduit means for feeding the synthetic resin to said nozzle means, and wherein said heating means is arranged so as to heat the feed conduit means to preheat the synthetic resin fed to the nozzle means.

31. Coating installation according to claim 30, wherein the heating means comprises an electrical heating unit.

32. Coating installation for workpieces, the coating installation comprising:

conveying means for conveying the workpieces along a predetermined path;

spray means for spraying a synthetic resin on said workpieces, said spray means being disposed adjacent said conveyor means and including a nozzle means directed toward said predetermined path for said workpieces;

heating means for heating the synthetic resin, at least predominantly, between said nozzle means and said predetermined path so as to heat the synthetic resin sprayed from said nozzle means predominantly before said sprayed resin reaches said path, and wherein the hating means comprises a microwave radiation source.

* * * * *